United States Patent [19]

Sutton

[11] 4,250,842

[45] Feb. 17, 1981

[54] ELECTRONIC INJECTION CARBURETOR

[75] Inventor: Robert W. Sutton, Elmira, N.Y.

[73] Assignee: The Bendix Corporation, Southfield, Mich.

[21] Appl. No.: 849,054

[22] Filed: Nov. 7, 1977

[51] Int. Cl.[2] ..... F02M 3/00; F02B 33/00

[52] U.S. Cl. ..... 123/472; 123/452; 123/438

[58] Field of Search ..... 123/119 EC, 119 R, 32 AE, 123/32 EA, 139 AW

[56] References Cited

U.S. PATENT DOCUMENTS

| | | | |
|---|---|---|---|
| 3,861,366 | 1/1975 | Masaki | 123/119 EC |
| 4,034,727 | 7/1977 | Aono | 123/119 EC |
| 4,084,562 | 4/1978 | Eckert | 123/119 EC |

*Primary Examiner*—Ronald B. Cox

*Attorney, Agent, or Firm*—William A. Marvin; Russel C. Wells

[57] ABSTRACT

An electronic injection carburetor is disclosed. Fuel under pressure is quantized for primary metering by an electronic fuel injector and input to a metered fuel chamber. The quantization occurs by controlling the duration of the opening time of the injector by an electronic control unit responsive to speed and manifold absolute pressure information. Secondary metering is provided as a function of the mass air flow through the throat of the carburetor by an actuator assembly controlling fuel input to the carburetor from the metered chamber. The actuator provides the secondary metering by changing the bias pressure on a flexible diaphragm producing a closure force on a needle valve that varies the flow of fuel from the metered chamber to an atomizing discharge nozzle in the throat of the carburetor.

15 Claims, 2 Drawing Figures

ELECTRONIC INJECTION CARBURETOR

BACKGROUND OF THE INVENTION

1. Field of the Invention

The invention pertains generally to carburetors or single point air/fuel ratio controllers for internal combustion engines and is more particularly directed to an electronic injection carburetor having primary and secondary metering functions.

2. Description of the Prior Art

Generally, carburetors in the prior art are well known and comprise basically a metering jet or jets located within a venturi. The metering jets and appropriate slow and fast idle adjustments are sized to provide an approximate air/fuel ratio as fuel is drawn into the carburetor throat by the suction or pressure drop of the air flowing past the venturi restriction. Such carburetors further employ a reservoir and float mechanism controlling a fuel pump for normally providing an acceleration well to draw fuel from for rapid advancements of a throttle plate. An accelerator pump may also be provided and attached controllably to the throttle in such a case for rapid transient response.

These systems depend on mass air flow through the venturi to provide a pressure drop or vacuum indicative thereof for controlling the metering function and while efficient to some extent do not provide an exact air/fuel ratio for all operating conditions. For example, an idle setting at a desired or a slightly richer than desired air/fuel ratio with a fixed metering jet will produce an even richer air/fuel ratio at high speeds because the fuel drawn into the venturi increases at a rate faster than the air flow. This rich operation is not fuel efficient over a wide range of operating speeds where economy and not power is necessitated.

The sizing of the venturi in a conventional carburetor is a tradeoff between high and low speeds. It is necessary to manufacture the restriction small enough to supply enough metering vacuum at low speeds and just off idle but not so small as to restrict engine air flow at higher speeds. Further, with a venturi, distributional problems of fuel may arise. Normally the jets must be centered in the area of highest vacuum for correct vaporization of the fuel. The central air/fuel charge must then spread out through the manifold to reach the individual cylinders. A system that was capable of a more even initial distribution of the air/fuel mixture as the charge is formed in the carburetor throat would increase fuel distribution effectiveness.

Conventional single point carburetion systems are, however, relatively inexpensive and provide a good response for transient operations. They additionally provide the relatively rich air/fuel ratios needed for high speeds and power operation at wide open throttle positions.

An example of a mass air flow carburetor including a a venturi is shown in a U.S. Pat. No. 2,733,901.

Operating at precise air/fuel ratio is becoming more important as fuel expense rises because fuel efficiency and power output are functions of the correct air/fuel ratio. It is known that for very lean air/fuel ratios power is lost and driveability is sacrificed and for very rich air/fuel ratios fuel is wasted because not all the available fuel is utilized. A stoichiometric air/fuel ratio or one relatively close thereto is envisioned as a desirable operating point for many operating conditions.

Moreover, governmental regulation of the amount of emissions in the exhaust gas of an engine is becoming a design factor in carburetion systems. Air/fuel ratios exceedingly rich or lean will cause emission problems. For example, in a three way catalytic converter system for reducing exhaust emissions, it is known that the air/fuel ratio must be controlled within a fairly narrow window for correct operation.

Therefore, electronic fuel injection apparatus have been devised to meet the need for a more precise air/fuel ratio than a carburetor can provide. Advantageously, the apparatus utilize multiple solenoid injectors that are controlled electronically by a control unit that schedules the opening times and amount of fuel injected for each injector. The opening times of each injector valve are calculated by operating parameters of the engine such as speed, manifold absolute pressure, and others to precisely provide a desired air/fuel ratio.

These injection apparatus are to this date, however, relatively expensive and generally include an extra transient sensing circuit to respond quickly to changing engine needs. This is because open loop fuel schedulers normally respond to parameters that are changed by the transients instead of the variable that produce them. Further, some delays are built into the sensors supplying speed-density information such as a MAP sensor which must average all cylinder pressure changes into an overall signal.

Still further, additional circuitry in case of a system failure of fuel delivery is generally provided in an electronic fuel injection system to permit the engine to limp home once the loss of the basic fuel metering pulse is recognized. At that point, most of the control over the accuracy of the air/fuel ratio is sacrificed so the car may be driven to where service is available.

Thus, it would be advantageous to provide a system with the better features of both the speed-density fuel injection system and the mass air flow carburetor. This would reduce the cost of such apparatus below a fuel injection system but would provide a better control of air/fuel ratio than a regular carburetor. Such a system would further be more responsive to transient conditions and tolerant to system failures without additional circuitry and would alleviate distributional and other venturi problems.

SUMMARY OF THE INVENTION

The invention provides a carburetor apparatus having a primary metering function corrected by a secondary metering function. The invention advantageously combines a speed-density system with a mass air flow system to regulate the metering functions according to the varied operating conditions of an internal combustion engine.

A fuel metering means provides primary metering as a function of the engine speed and the engine manifold pressure while secondary metering or correction of the primary metering is provided as a function of the mass air flow inducted through the throat of the carburetor. The fuel metering means includes a fuel injector means for producing the primary metering. In the preferred embodiment, the fuel injector means delivers a quantized amount of fuel to a metered fuel chamber by controlling the opening time duration of an electronic fuel injector. The opening of the injector is the result of energization by an electrical pulse width generated by an electronic control unit wherein the pulse width is calculated by the control unit from speed and manifold pressure information input from sensors to the unit.

The fuel metering means further includes an actuator means for secondary fuel metering proportionately to the mass air flow through the throat of the carburetor. Preferably, the actuator means comprises the metered fuel chamber and an actuator pressure chamber separated from the metered chamber by a flexible diaphragm member. The flexible diaphragm member normally applies a bias force against a needle valve to produce a fuel flow proportional to and controlled by the primary metering pressure of the fuel injector means. The bias force is then modified by changing the pressure in the actuator pressure chamber according to the mass air flow to produce the secondary metering function.

The fuel metering means incorporates many desirous features of both the electronic fuel injector means and the actuator means and provides a serial arrangement where if one means fails the engine maybe operated with an amount of fuel metering control retained.

Therefore, it is a primary object of the invention to provide a single point air/fuel ratio controller having a primary metering function dependent upon the speed-density relationship of the engine and a secondary metering function dependent upon a mass air flow relationship of the engine.

It is another object of the invention to provide a mass air flow correction to the fuel metering function of an internal combustion engine while maintaining good high speed engine breathing.

It is still another object of the invention to provide a fail-safe mode of carburetor operation by providing a dual metering function in series.

It is a further object of the invention to improve the distributional characteristics of the air/fuel charge and to maintain a precise air/fuel ratio over many operating engine conditions.

These and other objects, features, and aspects of the invention will be more fully understood from a reading of the following detailed description when taken in conjunction with the appended drawings wherein:

DETAILED DESCRIPTION

Figure 1:
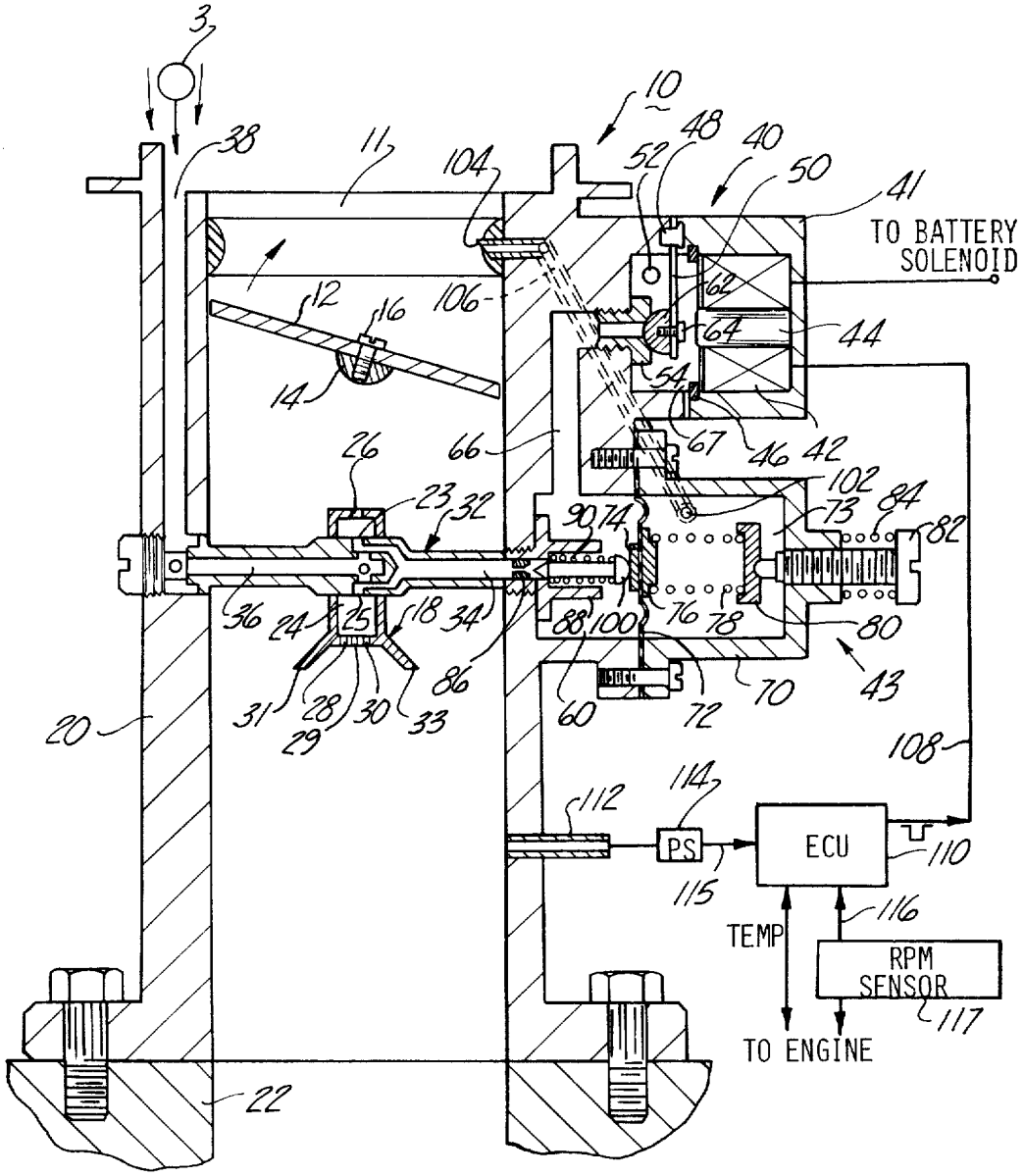
FIG. 1 is a partially sectioned, partially schematic view of an electronic injection carburetor constructed in accordance with the invention.

In FIG. 1 there is shown an electronic injection carburetor generally designated 10 for mixing air and fuel in a desired ratio to form a combustible charge. The air/fuel mixture is then inducted through a manifold 22 into the cylinders of an internal combustion engine to be burned and exhausted in a conventional power cycle. A throat 11 of the carburetor contains a throttle plate 12 which is connected by screw 16 to a rotatable member 14. The throttle plate 12 is operable through the rotation of member 14 to turn and provide various amounts of air to be inducted through the throat 11. A conventional linkage (not shown) can be provided to an accelerator or other operator controlled device to position the throttle 12 and hence control the speed or power output of the engine.

Further included in the carburetor throat 11 is a discharge means including an induction tube 32 and affixed thereto a discharge nozzle 18. The discharge nozzle 18 is advantageously located below the throttle plate 12 in the carburetor apparatus according to the invention to obviate the distributional problems that occur when the air/fuel mixture must pass by the throttle plate. If fuel must pass the throttle plate, there is a diversion of the charge from its original path and at times condensation and droplet formation on the plate. Also, ice can form on the plate from the moisture in the air being cooled because of the fuel absorbing heat from the plate in order to vaporize.

The induction tube 32 has two centrally located bores oppositely opposed, one of which is an airbleed 36 communicating with the atmosphere through an ambient inlet passage 38 and the second being a fuel passage 34 communicating with a source of fuel from a fuel metering means as will be hereinafter more fully described. The induction tube 32 supplies fuel and air to a mixing chamber 24 of the discharge nozzle 18 via ports 23, 25. Air inducted through the carburetor throat 11 enters the discharge nozzle 18 through an inlet 26 and thereby produces a flow to assist the mixture into the chamber 24 and aid in atomizing or vaporizing the air and fuel before being discharged through atomizing passages 28, 29 and 30 of the discharge nozzle 18. The difference in the manifold pressure below the throttle plate 12 and atmosphere for the airbleed 36 provides relatively strong atomization. Advantageously, no large restriction to air flow, such as a small venturi, has been placed in the carburetor throat 11. The high speed breathing characteristics of the carburetor 10 without these restrictions is considerably improved according to one of the objects of the invention.

The distribution of the charge of air and fuel issuing from nozzle 18 is enhanced by a slanted conical fin member shown in cross section at 31, 33 extending into the air flow of the carburetor throat 11. The fin member causes burbles and vortices in the air flow to thoroughly mix the atomized and partially vaporized charge with the inducted air in a substantially uniform manner before ingestion into the manifold 22. The mixing in the reduced pressure area below the discharge means will substantially vaporize the entire charge. Mixing of the combustible charge can be further enhanced in induction tube 32 by preheating air with heating means 3 before it enters ambient inlet passage 38. This enhances the mixing without substantially affecting the volumetric ratio of the engine.

While a preferred discharge apparatus has been described for the carburetor 10 it is evident that there are many others that will accomplish the mixture and vaporization function and the invention should not be limited to the particular means described.

It is evident that any desired air/fuel ratio may be provided with this discharge means by controlling the amount of fuel input through fuel passage 34. A metered amount of fuel is delivered through passage 34 to the discharge means by a fuel metering means comprising two separate metering devices working in cooperation or series. The first is an electronic fuel injector generally numeral 40 delivering a primary amount of fuel from an electrical injection pulse for a first metering and a second metering device, a mechanical actuator 43, which corrects the initial metering and provides a more accurate air/fuel ratio to that desired.

Electronic fuel injector 40 comprises a casing 41 attached to carburetor body 20 holding a set of coil windings 42 surrounding a magnetizable cylindrical core 44. The core and windings 42 are held in place in the casing by a spit-ring 46. The casing 41 which mounts onto and mates with a relieved portion of the throttle body 20 forms an unmetered fuel chamber 67 into which a fuel supply passage 52 provides fuel under a relatively low pressure from a fuel supply or reservoir (not shown).

Generally, modern fuel injectors require a high pressure fuel source to form a spray of fuel into the desired area to assist in the vaporization process and for distributional purposes. This high pressure is unnecessary to the present invention and a conventional fuel pump developing from 10–12 PSI of pressure will be adequate for the purposes described.

A metering jet 54 which is threaded into a tap of a fuel passage 66 communicates metered amounts of fuel from the unmetered chamber 67 to the passage via a centrally located bore of fixed orifice size. The orifice is sized such that wide open throttle conditions will be supplied with enough fuel at the maximum opening time. On the chamber side of the metering jet 54 is located a valve seat into which a hemispherical valve member 62 mates in a sealing relationship. The valve 62 is mounted by a magnetizable pole pin 64 at the distal end of a leaf spring 50. The leaf spring is cantilevered from a rivet 48 affixed to the carburetor body 20. When energized by an electrical signal on a terminal line 108, the coil 42 will magnetize core 44 thereby attracting pole pin 62 to open the valve and allow fuel to enter the fuel passage 66. By regulating the time of energization of coil 42 a metered amount of fuel will be allowed to enter.

The fuel passage 66 communicates with another relieved portion of the throttle body 20 defining a metered fuel chamber 60. Mounting into a tapped portion of the carburetor body 20 and having central bore communicating between the fuel passage 34 and the metered fuel chamber 60 is a fuel fitting 88. The central bore of the fuel fitting 88 contains a metering needle jet 86 with a conically shaped valve seat into which a needle valve 100 may be operably reciprocated to provide various amounts of fuel therethrough. The needle valve 100 is biased away from the jet 86 by a needle valve spring 90 mounted on a shoulder of the fuel fitting 88.

An actuator housing 70 defines a second chamber 73 by sealing between it and the metered fuel chamber 60 a flexible diaphragm 72 which is moveable as an indication of the differences in the pressures between the two chambers.

On one side of the diaphragm the spring 90 produces a force by biasing the head of needle valve 100 against a pressure pad 74. Opposing this force by a bias in the opposite direction is a spring pressure pad 76 with a diaphragm bias spring 78 pushing against a spring holder 80. The spring holder 80 is held in a stationary position by an adjusting screw 82, which may be turned to equalize the forces on the diaphragm thereby initially adjusting the opening of the needle jet 86. The adjustment screw 82 is biased outwardly by a spring 84 to take up the slack in the threads and produce an accurate bias for the needle valve.

Providing a vacuum which is proportional to the mass air flow through the carburetor throat 11 is a suction tube 104. The tube 104 communicates through its bore to a connecting tube 106 ending in a vacuum port 102 of the chamber 73. Thus, the mass air flow through the carburetor throat 11 will produce a vacuum signal felt by the chamber and of an amount proportional thereto and cause an equivalent deflection of diaphragm 72. The mass air flow signal is developed by a venturi not unduly restrictive to the high speed air flow characteristics.

Further included in the system is an electronic control unit 110 which will provide an electrical pulse of varying width over conductor 108 to open the electronic fuel injector for varying amounts of time. The ECU 110 will provide the varying pulse as a function of the manifold absolute pressure (MAP) which is input via a conductor 115 from a pressure sensor 114 communicating to the manifold pressure from a pressure tube 112. The pulse width is additionally a function of the speed of the engine which is input as a parameter from RPM sensor 117 via conductor 116. The ECU 110 will apply these sensed parameters to a fuel schedule and electronically calculate a pulse width corresponding thereto. Such electronic control units with open loop schedules that will produce a variable pulse width from manifold absolute pressure and RPM information are conventional in the art.

One advantageous example of such a control unit is found in a commonly assigned U.S. Pat. No. 3,734,068 issued to Reddy on May 23, 1973 the disclosure of which is herein expressly incorporated by reference. As pointed out by Reddy, various other parameters may also be used to determine the basic fuel pulse width.

In a preferred operation primary metering is performed according to the speed density method by ECU 110 providing a pulse proportional to the calculations done in the electronics to the electronic injector 40 and secondary metering is performed by the mass air flow method by the actuator 43 correcting the primary metered fuel input to the fuel passage 34.

It is evident from the beforegoing description that after an initial setting by the idle screw 82 fuel will flow according to the differences in the pressures between the plenum or metered fuel chamber 60 and the vacuum or actuator pressure chamber 73. The effect of some vacuum from the discharge means will be negligible on the positioning of the needle valve 100. The pressure in the plenum chamber 60 is regulated by the opening and closing times of the injector 40 as calculated by the ECU 110. The pressure in the vacuum chamber 73 will be regulated according to the mass air flow past the suction tube 104.

According to one of the objects of the invention if the ECU 110 fails, the injector 40 will remain open to provide fuel to the engine and metering will be controlled by the vacuum in chamber 73. This parallel operation provides a fail-safe method of operation where conversely, if the actuator 43 fails then the fuel injector means 40 will provide metering. A normally open switch in the control line 108 is connected to the start sequence circuitry to prevent flooding when the engine is not in operation.

Figure 2:
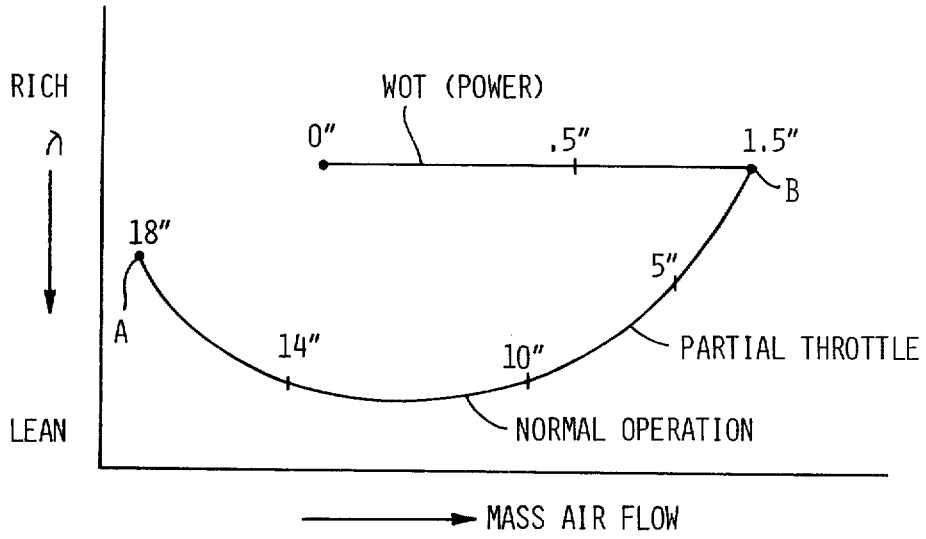
FIG. 2 is a diagrammatic illustration of the functional relationship of primary fuel metering accomplished by a speed-density approach corrected by a secondary fuel metering accomplished by a mass air flow approach.

With reference now to FIG. 2 there is shown one preferred method of programming the ECU 110 in combination with the mass air flow correction of actuator 43. The graph illustrates air/fuel ratio numbers ($\lambda$) as a function of mass air flow. The lower curve labeled normal operation describes the engine air/fuel ratios for various throttle openings and manifold pressures (in inches of mercury). The upper curve labeled power describes the engine air/fuel ratios for wide open throttle and manifold pressures (in inches of mercury).

It is seen at an idle condition, point A, large manifold vacuums are present and a relatively rich (small λ) ratio is needed. As the throttle is opened the mass air flow increases, the manifold vacuum decreases, and speed of the engine increases. This is the cruising range of the engine and relatively lean air/fuel ratios should be applied to increase fuel economy. Considerable amounts of the operation time will be spent in this region.

For higher speeds and loads the air/fuel ratio needs to be enriched to where at wide open throttle and maximum speed (point B) the optimum power ratio is reached. For lower speeds at wide open throttle with maximum power this ratio should be maintained as illustrated by the upper curve.

At idle conditions (point A), when air flow will be low, the injector 40 will supply the main fuel pressure to the discharge means. This will provide the rapid and highly desirable starting characteristic found in many fuel injection systems. The fuel plenum chamber 60 will average the pulses to a considerable extent and prevent throbbing that could occur with low speed pulses from a single injector accelerating and decelerating an engine during idle. As described in the referenced Reddy Patent, during cold starting and idle conditions the air/fuel ratio maybe scheduled richer than a stoichiometric ratio.

For normal constant operating speeds and normal loads when major operation occurs the injector 40 can regulate or schedule fuel flow at a leaner than stoichiometric air/fuel ratio while the mass air flow signal to chamber 73 will not aid the operation significantly. However, the mass air flow correction if desired to be significant can be compensated for in the open loop schedule to any desired metering flow.

During transients, such as accelerations, the pressure from chamber 73 will change more rapidly than the fuel pressure in chamber 60 and the needle valve will respond to mass air flow. The fuel chamber 60 supplies an acceleration well for the discharge means to draw fuel from during these conditions until the pressures are equalized by the fuel injector 40 and ECU 110 responding to the transient. Thus, no accelerator pump is needed as would be the case in a conventional carburetor.

Higher power necessitated during heavy loads or at high RPM ranges (point B) can be delivered by having the fuel injector scheduled with a full rich or wide open throttle pulse width and a correction for a richer air/fuel ratio and metering being maintained by the vacuum chamber 73.

For a single injector system this operation can alleviate pulse width problems and extend the range of the carburetor. It is difficult to size a single injector to deliver precise quantities at a short pulse width and low speed and then provide a long enough pulse to deliver the correct quantities at high speed. The range of the injector and, therefore, the carburetor can be extended by opening the injector with the longest pulse available and thereafter regulating according to mass air flow. As the metering is a function of the pressure difference on the diaphragm 72 and the back pressure on fuel in the meter chamber 67, more fuel maybe delivered at higher air flows than is available at only the injector 40. At some adjustable point, the mass air flow pressure on the diaphragm will not only correct but also overtake the primary metering pressure from the injector.

Although this scheduling and operation for air/fuel ratio is preferred for the apparatus, it is evident that other programming is available because of its operational flexibility. Many working combinations of the speed-density metering and mass air flow metering can be accomplished by the device.

Therefore, while a preferred embodiment of the invention has been shown, it will be obvious to those skilled in the art that various modifications and changes can be made thereto without departing from the spirit and scope of the invention as defined in the following appended claims:

What is claimed:

1. An electronic injection carburetor for an internal combustion engine having an intake manifold which receives fuel from a pressurized fuel supply, said carburetor comprising:

a carburetor body with a throat for communicating air inducted from the atmosphere to the intake manifold of at least one cylinder of the engine;

discharge means for mixing a metered amount of injected fuel with the inducted air, said mixing forming a combustible charge in said throat of said carburetor of a desired air/fuel ratio which is thereafter drawn into the intake manifold; and means for metering said amount of injected fuel from the pressurized fuel supply to said discharge means, said metering means including a fuel injector for primary fuel metering from the supply; said fuel injector supplying metered amounts of fuel at a rate proportional to the speed and manifold absolute pressure of the engine; and said metering means further including an actuator for secondary fuel metering, said actuator receiving said primary metered fuel from said fuel injector and metering said primary metered fuel proportionally to the mass air flow of inducted air through the throat of the carburetor.

2. An electronic injection carburetor for an internal combustion engine as defined in claim 1 wherein said discharge means is located between said throttle plate means and the intake manifold such that the inducted air is mixed with the fuel after it passes the throttle plate.

3. An electronic injection carburetor for an internal combustion engine as defined in claim 1 wherein said discharge means comprises:

an induction tube for atomizing fuel with air, said induction tube having an airbleed bore communicating to the atmosphere and a fuel passage communicating to said full metering means, said airbleed bore and said fuel passage meeting at a plurality of exit ports to mix air and fuel in an atomized charge as it leaves the exit ports;

discharge nozzle means having a mixing chamber under vacuum communicating with said exit ports for vaporizing said atomized air/fuel mixture and discharging the vaporized mixture into the inducted air to form said charge.

4. An electronic injection carburetor as defined in claim 3 wherein said discharge nozzle means includes means for distributing the combustible charge uniformly across the throat of the carburetor.

5. An electronic injection carburetor as defined in claim 4 wherein said distribution means includes a central discharge means for discharging fuel centrally to prevent wetting of the carburetor walls and intake manifold walls.

6. An electronic injection carburetor as defined in claim 5 wherein said airbleed includes:

means for heating the atomizing air such that the volumetric efficiency of the engine is not affected.

7. An electronic injection carburetor as defined in claim 1 wherein said injector means includes:

a metering jet having a bore sized to provide a constant flow rate of fuel therethrough and said bore communicating with said pressurized fuel supply;

an electrical valve responsive to an electrical signal for opening and closing said metering jet where said metering will supply a varying quantity of fuel dependent the opening time of said valve; and an electronic control unit for receiving speed and manifold absolute pressure information from the engine and applying said information to a fuel schedule to calculate an opening time for said valve representative of a desired air/fuel ratio, said control means generating said electrical signal equivalently to said calculated opening time to provide said primary fuel metering.

8. An electronic injection carburetor as defined in claim 7 wherein said actuator means includes:

a metered fuel chamber receiving fuel from said pressurized supply through said metering jet;

secondary metering means for metering fuel from said metered fuel chamber to said discharge means responsive to vary fuel flow as a function of the mass air flow of the inducted air and the pressure of the fuel in said metered chamber.

9. An electronic injection carburetor as defined in claim 8 wherein:

said secondary metering means includes means for initially adjusting the amount of fuel flow to said discharge means.

10. An electronic injection carburetor as defined in claim 9 wherein:

said secondary metering means includes a metering assembly having a needle valve operably cooperating with a secondary metering jet to vary the amount of fuel through the jet.

11. An electronic injection carburetor as defined in claim 10 wherein:

said metering assembly is controlled to vary the position of the needle valve with a flexible diaphragm member responding to the fuel pressure in said metered chamber.

12. An electronic injection carburetor as defined in claim 11 wherein:

said flexible diaphragm member is additionally controlled by vacuum means for generating a pressure on said diaphragm member proportionately to the mass air flow through the throat of said carburetor.

13. An electronic injection carburetor for an internal combustion engine having an intake manifold which receives fuel from a pressurized fuel supply, said carburetor comprising:

a carburetor body with a throat for communicating air inducted from the atmosphere to the intake manifold of at least one cylinder of the engine;

discharge means for mixing a metered amount of injected fuel with the inducted air, said mixing forming a combustible charge in said throat of said carburetor of a desired air/fuel ratio which is thereafter drawn into the intake manifold; and means for metering said amount of fuel from the pressurized fuel supply to said discharge means including an electronic intermittent fuel injector for metering a primary quantity of fuel as a function of at least one operating parameter of the engine; wherein said fuel injector is supplied from the pressurized supply and meters said primary quantity into a variable volume metered fuel chamber; said fuel metering means further including means for metering a secondary quantity of fuel as a function of at least one operating parameter of the engine; said secondary metering means metering said second quantity of fuel from said metered fuel chamber to said discharge means.

14. An electronic injection carburetor as defined in claim 13 wherein:

said metering fuel chamber varies in volume as a function of at least one operating parameter of the engine.

15. An electronic injection carburetor as defined in claim 14 wherein:

said metered fuel chamber varies in volume as a function of said primary quantity of fuel.

* * * * *